US011130922B2

(12) United States Patent
Zhang

(10) Patent No.: US 11,130,922 B2
(45) Date of Patent: Sep. 28, 2021

(54) HYDROGEN BOILER BASED ON COAL GASIFICATION AND WATER DECOMPOSITION

(71) Applicant: Fujian Jungie New Material Technology Company Limited, Fujian (CN)

(72) Inventor: Daji Zhang, Fujian (CN)

(73) Assignee: Fujian Jungie New Material Technology Co., Ltd., Ningde (CN)

( * ) Notice: Subject to any disclaimer, the term of this patent is extended or adjusted under 35 U.S.C. 154(b) by 0 days.

(21) Appl. No.: 16/792,221

(22) Filed: Feb. 15, 2020

(65) Prior Publication Data

US 2020/0231885 A1 Jul. 23, 2020

Related U.S. Application Data

(63) Continuation of application No. PCT/CN2018/000289, filed on Aug. 6, 2018.

(30) Foreign Application Priority Data

Aug. 14, 2017 (CN) ..... 201710717347.1

(51) Int. Cl.
*C10J 3/86* (2006.01)
*F22B 31/04* (2006.01)

(52) U.S. Cl.
CPC ..... *C10J 3/86* (2013.01); *F22B 31/04* (2013.01); *C10J 2300/093* (2013.01); *C10J 2300/0976* (2013.01); *C10J 2300/169* (2013.01)

(58) Field of Classification Search
CPC ..... C10J 3/86; C10J 2300/093; C10J 2300/0976; C10J 2300/169; F22B 31/04
See application file for complete search history.

(56) References Cited

U.S. PATENT DOCUMENTS 5,895,508 A * 4/1999 Halow ..... C10K 1/026 48/77
2009/0020456 A1* 1/2009 Tsangaris ..... C10J 3/523 208/133
2011/0243800 A1* 10/2011 Gallmetzer ..... F23C 10/18 422/146
2012/0159841 A1* 6/2012 Fan ..... C01B 3/344 44/457

* cited by examiner

*Primary Examiner* — Matthew J Merkling

(57) ABSTRACT

The invention provides a hydrogen boiler based on coal gasification and water decomposition, including a steam boiler which includes an upper furnace and a lower furnace; water and steam in the upper furnace are respectively communicated with water and steam in the lower furnace; and the steam boiler is provided with a casing which has a narrow gap for containing water and a wide wall for heating to generate gas. The steam boiler contains multistage reactors. A coal modification and gasification device is provided at an outer side of the steam boiler and is provided with two chambers. The steam and gasified gas of coal are mixed and enter the reactors for direct burning to promote respective reactions. After several stages of modification and decomposition, the steam and the gasified gas of coal are completely converted to hydrogen.

2 Claims, 1 Drawing Sheet

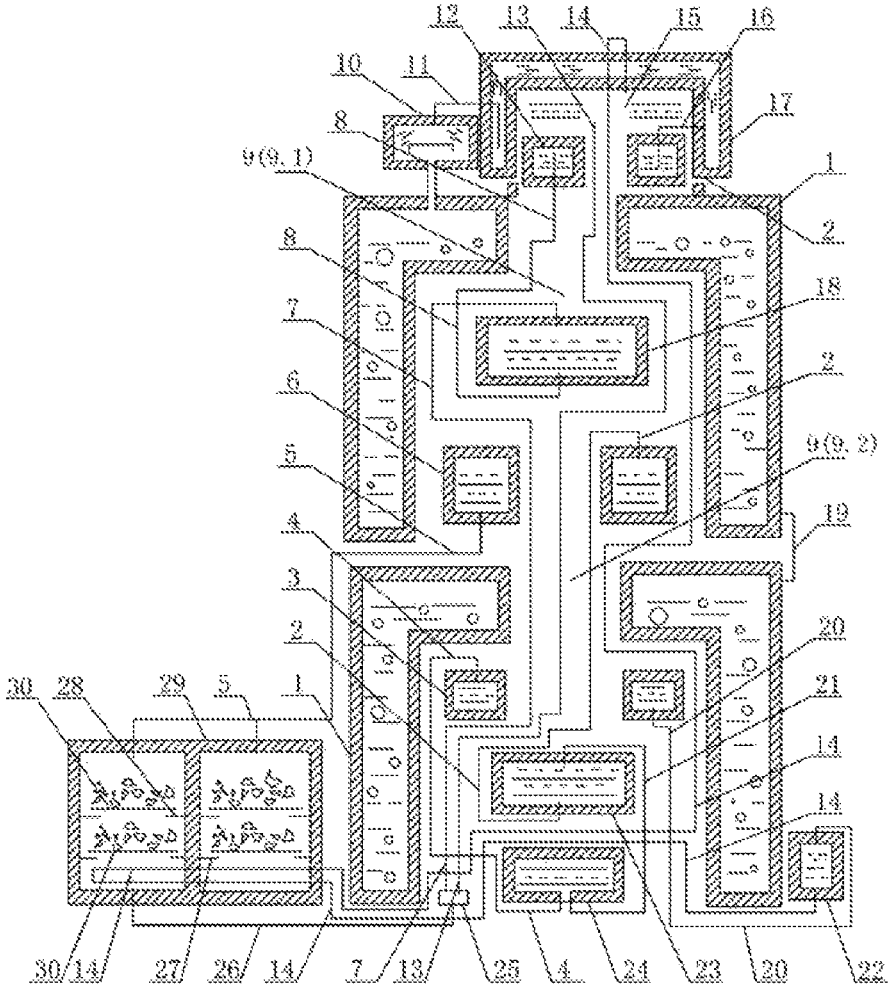
12
13
14
15
16
10
11
17
8
9(9, 1)
1
2
8
18
7
2
6
9(9, 2)
5
19
4
3
20
2
21
30
28
29
5
1
14
14
30
14
27
26
14
7
13
25
4
24
23
20
22

HYDROGEN BOILER BASED ON COAL GASIFICATION AND WATER DECOMPOSITION

CROSS-REFERENCE TO RELATED APPLICATIONS

This application is a continuation of International Application No. PCT/CN2018/000289, filed on Aug. 6, 2018, which claims the benefit of priority from Chinese Patent Application No. 201710717347.1, filed on Aug. 14, 2017. The content of the aforementioned applications, including any intervening amendments thereto, are incorporated herein by reference.

TECHNICAL FIELD

This application relates to a steam boiler used in industry, agriculture and daily life, and more particularly to a hydrogen boiler based on coal gasification and water decomposition, which achieves a self-sufficient hydrogen generated by coal gas and steam for burning and heating by mixing gasified gas of coal with water steam for a circular reaction of decomposition and modification.

BACKGROUND OF THE INVENTION

Traditionally, coal is directly burned in coal-fired boilers, resulting in a low heat efficiency and serious pollution. Coal modification is a solution to this problem. In the prior art, for single biolers, one steam boiler is provided with one coal gasifier to generate gas in a dry distillation method, so that the generating and burning of gas are realized at the same time. In this way, most dust pollution can be eliminated. However, the cost and fuel consumption of the gasifier will increase the production and use cost of the steam boiler, and decrease the integral energy efficiency. Moreover, the pollution is not completely eliminated. So, this method is only expedient and not an efficient technical solution to achieve the high efficiency, low cost and free pollution, and thus is not commercially accepted. There is another method for gas modification, in which the coal is gasified to the coal gas, and then modified and purified into hydrogen, and finally the hydrogen is transmitted for use, which always lacks social and economical reasonability, making it hard to be commercial and market-oriented, let alone the application to single steam boilers. In addition, Chinese Patent No. 204648215 U discloses a boiler for generating and using hydrogen, where a wet decomposition method is provided to modify the coal which is originally burned directly to gasified gas, and the gasified gas is decomposed and burned when combining with some steam. This method is much improved, but still has the following defects in real application. Firstly, since a static gasifier is adopted, it requires a strong labor intensity to feed materials and retract slags; especially in a heating process of the coal gasification, the coal will be softened to sludge after heating, making it difficult to circulate and exchange the gas, so that steam of high temperature and high pressure is required to blow the sludge to float to ensure the gasification to be proceeded, which increases the operation difficulty and the equipment cost. Secondly, the gasified gas of coal burns directly after entering a furnace burner, causing the inadequate energy efficiency, because the gasified gas consists of $H_2$ and CO which can be modified again to reduce the content of CO, increase $H_2$ and additionally increase flammable gas decomposed from the steam. Thirdly, a purifier for the steam is provided on a top of the boiler; however, it is not realistic to allow the gas generated in the purifier to enter the gasifier of coal and participate in the modification reaction, because a gas source of the purifier is produced and consumed by itself; moreover, the purifier uses fire rear and waster heat of the furnace to heat to produce gas; because of a sufficient heat source, a significant amount of steam can be produced, which is mixed with the fire rear and smoke to generate a large amount of surplus gas of normal temperature and normal pressure; the surplus gas is greatly different from the gas of high temperature and high pressure in the gasifier, so the surplus gas cannot be injected and used effectively. Fourthly, it is difficult to clean the calcification and solidification of $CO_2$ retained in the purifier conveniently; because there is no method to remove $CO_2$ once for all, zero release is achieved by regular elimination, transfer and storage; however, it is hard to ensure the fulfillment of this process if the design is unreasonable, the operation is inconvenient and there is no supervision; in addition, if the operator has little environmental awareness, the purifier will be useless.

To overcome the defects in the prior art, this invention further optimizes and upgrades the available hydrogen boiler for coal modification, and provides a clean hydrogen boiler for a mixed modification of coal and water, which provides a coal gasification with a fast gasification speed, a high hydrogen conversion efficiency, no loss in conversion of thermal energy, a complete interception of pollution, an easy operation and low cost, and reduces coal consumption because of an additional flammable gas decomposed from the steam.

SUMMARY OF THE INVENTION

To achieve the above-mentioned objects, the invention adopts the following technical solutions.

The invention provides a hydrogen boiler based on coal gasification and water decomposition, comprising a steam boiler which comprises an upper furnace and a lower furnace; wherein water and steam in the upper furnace are respectively communicated with water and steam in the lower furnace; the steam boiler is provided with a casing which has a narrow gap for containing water and a wide wall for heating to generate gas; multistage reactors are contained in the upper and lower furnaces of the steam boiler;

a coal modification and gasification device is provided at an outer side of the steam boiler and is provided with two chambers; each of the two chambers is provided with two tracks and two layers of material beds which are foldable and removable;

steam and gasified gas of coal are mixed and enter the reactors in the upper and lower furnaces for direct burning to promote respective reactions in the reactors; and after several stages of modification and decomposition, the steam and the gasified gas of coal are completely converted to hydrogen.

In the steam boiler, a steam separation and drying device having a cap-shaped interlayer is provided at a tail gas outlet of the upper furnace of the steam boiler; a primary tail gas modifier is provided at an upper part of a cavity of the steam separation and drying device; a primary steam modification and decomposition reactor is circular and is provided at a lower part of the cavity of the steam separation and drying device; a steam controller is provided at a steam outlet of the steam boiler at an outer side of the steam separation and drying device; a water source is provided at a bottom of the steam boiler; a plurality of connectors for water and steam are arranged between the upper furnace and the lower furnace of the steam boiler; a $CO_2$ remover is provided at an outer side of the lower furnace of the steam boiler; a secondary steam modification and decomposition reactor is provided at an upper part of the upper furnace; a secondary water gas modification reactor is circular and is circumferentially provided at a lower part of the upper furnace of the steam boiler; a secondary tail gas modifier is circular and is circumferentially provided at an upper part of the lower furnace; a tertiary water gas modification reactor is provided at a middle part of the lower furnace; a burner is provided at a lower part of the lower furnace and is configured to convert infrared ray, water gas and the steam to hydrogen through reactions of mixing, modification and decomposition; and a steam distributor is provided at a side of the burner.

In the coal modification and gasification device, a calandria reflux heater using inner thermal dissipation is provided at a lower part of an interior of the coal modification and gasification device and is formed by a part of a pipeline for introducing a heat source from fire tail and tail gas discharged from the upper and lower furnaces of the steam boiler; a first track is provided along left and right walls of a middle of a lower part of the interior of the coal modification and gasification device, and a second track is provided along left and right walls of a middle of the interior of the coal modification and gasification device; and the material beds are arranged on the first and second tracks.

The steam, water gas and tail gas are exchanged in a circulatory system, wherein the calandria heater, the steam distributor, the burner, the reactors, the steam controller, decomposition devices, the $CO_2$ remover, the modification and gasification devices for coal and the steam boiler are connected via a plurality of pipes, so that the modification and gasification of coal and water are promoted to convert the gasified gas of coal to hydrogen, decompose the steam of water to flammable gas and effectively utilize the tail gas; and low cost and free pollution are achieved by increasing a contribution of steam to the flammable gas to change an direct burning or a direct consumption of modified gas of coal originally to a hydrogen generation using one part of modified gas of coal to drive one part of water to be decomposed into hydrogen.

Compared with the prior art, this invention has the following improvements and beneficial effects.

The waste heat of a fire tail in the furnaces of the steam boiler is introduced to the coal modification and gasification device to provide a heat source for the gasification of coal, which not only increases the effective utilization rate of energy, but also plays a critical role in the gasification of coal. In addition, since the calandria heater is adopted for heat conduction, a high thermal efficiency is provided, and it is possible to regulate the temperature, pressure and humidity during the gasification to allow a simultaneous process of dry distillation and wet decomposition, and a crossover separation of dry space from moist space. Moreover, subsequent slags of the wet decomposition can be dry distillated again to generate CO to react with the steam and generate hydrogen, which overcomes the defects in the prior art. In the prior art, the wet decomposition and the self-heating dry distillation are achieved by only using high-pressure steam provided by a high-pressure boiler. Meanwhile, due to the tracks for transferring the coal material and the foldable and removable beds for material spreading, it is convenient to feed materials and retract slags, resulting in a reduced labor intensity and good gas permeability, quick and exhaustive decomposition, which especially solves serious problems such as a mud corner generated by sludge of the coal heated and softened by the steam and a cold air, and a difficulty of circulation and exchange reaction. Reaction requirements of high temperature and high pressure are relatively decreased, so that the technical difficulty and production cost are reduced.

The circulatory system for the steam, the water gas and the tail gas is independent, which creates a modification environment by itself without relying on the regulation by the high-temperature and high-pressure steam of the furnace to achieve the modification and decomposition, relieving limitations of complex techniques and high cost.

The primary tail gas modifier expands the thermal efficiency by recycling the heat, and simultaneously promotes the pollutants to convert to a clean energy, so that the modification and decomposition are achieved continuously and simultaneously to gradually reduce the inflated volume till zero, thereby eliminating chimneys and achieving zero discharging.

Water is filled in the upper and lower furnaces of the steam boiler. A self-expansion, generated by a heat difference between the upper and lower furnaces and a pressure difference at the connectors for water and steam, reduces the density of water in the cavity of the upper and lower furnaces, and increases the generating speed and promotes the atomization of steam. Some separated and dried steam is introduced into the decomposition system, which can not only be modified and decomposed to hydrogen, but also speed up the modification of coal, and the tail gas and water gas are mixed and modified to generate hydrogen.

This invention can be used as a boiler system to supply and consume heat by itself, and also can be used just as a hydrogen generator to generate and purify hydrogen, and the hydrogen is directly transmitted for use.

BRIEF DESCRIPTION OF THE DRAWINGS

The present invention will be described further with reference to the accompanying drawings.

FIG. 1 is a schematic diagram of a hydrogen boiler based on coal gasification and water decomposition according to an embodiment of the present invention.

DETAILED DESCRIPTION OF EMBODIMENTS

The invention provides a hydrogen boiler based on coal gasification and water decomposition, comprising a steam boiler 1 which comprises an upper furnace 9.1 and a lower furnace 9.2; water and steam in the upper furnace are respectively communicated with water and steam in the lower furnace; the steam boiler 1 is provided with a casing which has a narrow gap for containing water and a wide wall for heating to generate gas;

a burner 24 is provided at a middle of a lower part of a lower furnace 9.2 of the steam boiler 1, and a steam distributor 25 is provided at a side of the burner 24; a tertiary gas water modification reactor 23 is provided at a middle of a middle part of the lower furnace 9.2; a secondary tail gas modifier 3 is circular and is circumferentially provided at an upper part of the lower furnace 9.2;

a secondary water gas modification reactor 6 for is circular and is circumferentially provided at a lower part of an upper furnace 9.1 of the steam boiler 1; a secondary steam modification and decomposition reactor 18 is provided at a middle of an upper part of the upper furnace 9.1; a steam separation and drying device 17 having a cap-shaped interlayer is provided at a tail gas outlet of the upper furnace 9.1 of the steam boiler 1;

a primary tail gas modifier 15 is provided at an upper part of a cavity of the steam separation and drying device 17; a primary steam modification and decomposition reactor 12 is circular and is provided at a lower part of the cavity of the steam separation and drying device 17; a steam controller 10 is provided at a steam outlet of the steam boiler at an outer side of the steam separation and drying device 17;

a plurality of connectors 19 for water and steam are arranged between the upper furnace 9.1 and the lower furnace 9.2 of the steam boiler 1; a $CO_2$ remover 22 is provided at an outer side of the lower furnace 9.2 of the steam boiler 1; a coal modification and gasification device 29 is provided at the other outer side of the lower furnace 9.2 of the steam boiler 1 and is provided with two chambers; each of the two chambers is provided with two sets of tracks and two layers of foldable and removable beds 30 for material spreading;

a calandria heater for backflow using inner thermal dissipation is provided at a lower part of an interior of the modification and gasification device 29 for coal and is formed by a part of a pipeline 14 for introducing a heat source from fire tail and tail gas discharged from the upper and lower furnaces 9 of the steam boiler 1; a first track 27 is provided along left and right walls of a middle of a lower part of the interior of the coal modification and gasification device 29, and the material beds 30 are arranged on the first track 27; a second track 28 is provided along left and right side walls of a middle of the coal modification and gasification device 29, and the material beds 30 are arranged on the second track 28.

The steam of the steam boiler 1, water gas of the coal modification and gasification device 29, and tail gas of the upper and lower furnaces 9 are exchanged in a circulatory system as follows.

The steam enters the steam controller 10 from the steam outlet of the steam boiler 1; through a first gas pipe 11, to the cap-shaped interlayer of the steam separation and drying device 17; through a second gas pipe 16, to the primary modification and decomposition reactor 12 for first decomposition; through a third gas pipe 8, to the secondary modification and decomposition reactor 18 for second decomposition; through a fourth gas pipe 7, to the steam distributor 25, and then through a fifth gas pipe 26, into the coal modification and gasification device 29, and through a sixth gas pipe 13, into the primary tail gas modifier 15, respectively; at the same time, the steam and the tail gas are gathered and mixed in the primary tail gas modifier 15 to generate a modified gas mixture, and the modified gas mixture, as a heat source, enters the lower part of the coal modification and gasification device 29 via the calandria reflux heater, so that the heat transfer circulation for the coal modification and gasification device 29 is realized; the modified gas mixture is transferred to the $CO_2$ remover 22 through the pipeline 14; after an interception for $CO_2$, the modified gas mixture is transferred to the secondary tail gas modifier 3 for enhanced modification through a seventh gas pipe 20, and enters a lower part of the burner 24 through an eighth gas pipe 4.

The water gas is modified in the coal modification and gasification device 29 and enters the secondary water gas modification reactor 6 for a second modification through a ninth gas pipe 5, then enters the tertiary water gas modification reactor 23 for third modification through a tenth gas pipe 2, and enters the lower part of the burner 24 through an eleventh gas pipe 21; and in this way, the modified gas mixture and the water gas are gathered at the lower part of the burner 24. A reaction bed is raised to approach an infrared burning plate, and to intercept surplus steam using infrared ray for forced decomposition and modification to increase transformation and combustion efficiency of hydrogen.

What is claimed is:

1. A hydrogen boiler based on coal gasification and water decomposition, comprising a steam boiler which comprises an upper furnace and a lower furnace; wherein water and steam in the upper furnace are respectively communicated with water and steam in the lower furnace; the steam boiler is provided with a casing which has a narrow gap for containing water and a wide wall for heating to generate gas;

a burner is provided at a middle of a lower part of the lower furnace of the steam boiler, and a steam distributor is provided at a side of the burner; a first reactor configured for a secondary reaction of water gas with steam to produce hydrogen is provided at a middle of a middle part of the lower furnace; a second reactor configured for secondary reaction of tail gas with steam to produce hydrogen is circular and is circumferentially provided at an upper part of the lower furnace;

a third reactor configured for a primary reaction of the water gas with the steam to produce the hydrogen is circular and is circumferentially provided at a lower part of an upper furnace of the steam boiler; a fourth reactor configured for secondary decomposition of the steam to produce hydrogen is provided at a middle of an upper part of the upper furnace; a steam separation and drying device having a cap-shaped interlayer is provided at a tail gas outlet of the upper furnace of the steam boiler;

a fifth reactor configured for primary reaction of tail gas with steam to produce hydrogen is provided at an upper part of a cavity of the steam separation and drying device; a sixth reactor configured for primary decomposition of steam to produce hydrogen is circular and is provided at a lower part of the cavity of the steam separation and drying device; a steam controller is provided at a steam outlet of the steam boiler outside the steam separation and drying device;

a plurality of connectors for water and steam are arranged between the upper furnace and the lower furnace of the steam boiler; a $CO_2$ remover is provided at an outer side of the lower furnace of the steam boiler; a seventh reactor configured for gasification of coal using steam to produce water gas is provided at the other outer side of the lower furnace of the steam boiler and has two chambers; each of the two chambers is provided with a first track and a second track; and two layers of material beds are arranged on the first track and second track, respectively, wherein the two layers of material beds are foldable and detachable from the first track and the second track, respectively; and a calandria reflux heater using inner thermal dissipation is provided at a lower part of an interior of the seventh reactor and is formed by a part of a pipeline for introducing a heat source from fire tail and tail gas discharged from the upper and lower furnaces of the steam boiler; the first track is provided along opposite walls of a middle of a lower part of the interior of the seventh reactor, and the second track is provided along opposite walls of a middle of the interior of the seventh reactor.

2. The hydrogen boiler of claim 1, wherein the steam from the steam outlet of the steam boiler enters the steam controller, through a first gas pipe, to the cap-shaped interlayer of the steam separation and drying device; through a second gas pipe, to the sixth reactor through a third gas pipe, to the fourth reactor; and through a fourth gas pipe, to the steam distributor; and then through a fifth gas pipe, to the seventh reactor and through a sixth gas pipe, to the fifth reactor; the steam and the tail gas are gathered and mixed in the fifth reactor to generate a gas mixture, and the gas mixture, as a heat source, enters the lower part of the seventh reactor via the calandria heater with backflow, so that heat transfer circulation for the seventh reactor is realized; the gas mixture is transferred to the $CO_2$ remover through the pipeline; after the removal of $CO_2$, the gas mixture is transferred to the second reactor through a seventh gas pipe, and enters a lower part of the burner through an eighth gas pipe; and the water gas is produced in the seventh reactor and enters the third reactor through a ninth gas pipe, then enters the first reactor through a tenth gas pipe, and enters the lower part of the burner through an eleventh gas pipe; and in this way, the gas mixture and the water gas are gathered at the lower part of the burner.

* * * * *